United States Patent [19]

Cantarella et al.

[11] 4,270,617

[45] Jun. 2, 1981

[54] EARTH MOVING MACHINE OF THE SCRAPING BLADE TYPE

[75] Inventors: Bruno G. Cantarella; Carlo Cecchi, both of Turin, Italy

[73] Assignee: Fiat-Allis Macchine Movimento Terra S.p.A., Lecce, Italy

[21] Appl. No.: 54,965

[22] Filed: Jul. 5, 1979

[30] Foreign Application Priority Data

Jul. 10, 1978 [IT] Italy ..... 68322 A/78

[51] Int. Cl.[3] ..... E02F 3/76

[52] U.S. Cl. ..... 172/821; 172/812; 172/825; 172/701.1

[58] Field of Search ..... 172/801–809; 92/117 R, 117 A, 118; 91/216 R, 216 A, 216 B

[56] References Cited

U.S. PATENT DOCUMENTS

| | | | |
|---|---|---|---|
| 1,997,001 | 4/1935 | Lamb | 172/803 |
| 2,299,430 | 10/1942 | Sexton | 91/216 A |
| 3,529,678 | 9/1970 | Teasdale | 172/809 X |
| 3,661,215 | 5/1972 | Pensa | 172/804 |
| 3,913,684 | 10/1975 | Casey | 172/805 |
| 3,991,832 | 11/1976 | Cooper | 172/804 |
| 4,013,132 | 3/1977 | Matsuzawa | 172/804 |
| 4,081,036 | 3/1978 | Yokoyama | 172/804 |
| 4,114,724 | 9/1978 | Doolittle | 92/118 |

FOREIGN PATENT DOCUMENTS

| | | | |
|---|---|---|---|
| 354015 | 5/1922 | Fed. Rep. of Germany | 92/117 R |

*Primary Examiner*—Richard J. Johnson
*Attorney, Agent, or Firm*—August E. Roehrig, Jr.; Robert A. Brown

[57] ABSTRACT

An earth moving machine having an improved mounting for a scraping blade attached thereto. The scraping blade of the machine herein disclosed is capable of undergoing independent or simultaneous rotational movement about three perpendicular axes and applying high forces to material to be moved. Movement about two of these axes is controlled by two separate pairs of hydraulic cylinders. A hydraulic actuator effects movement of the blade about a third axis and acts to transmit a part of the force applied to the blade during operation to the frame of the machine.

9 Claims, 6 Drawing Figures

EARTH MOVING MACHINE OF THE SCRAPING BLADE TYPE

BACKGROUND OF THE INVENTION

This invention relates in general to an earth moving machine and, in particular, to a mounting for the scraping blade of an earth moving machine of the crawler type.

More specifically, but without restriction to the particular use which is shown and described, this invention relates to an earth moving machine having an improved blade which is capable of independent or simultaneous movement about three perpendicular axes to accomplish highly effective operational results. Such control of the blade as herein disclosed is coupled with an energy absorbing mounting to efficiently dissipate forces generated during operation of the machine.

In prior art machines of this type, resultant forces applied to the blade by the material being moved are normally transmitted to the machine frame through two connections, one through the pivot between the C-frame and the vehicle frame, the other between the lift cylinders and the vehicle frame. The forces from the blade are transmitted to the C-frame through three connections, one between the blade directly to the C-frame, the second between the blade and hydraulic means to the C-frame, the third between the blade and additional hydraulic means. The blade is controlled by the C-frame in rotating about three mutually perpendicular axes, the first being horizontal to the length of the machine, the second axis being vertical to the C-frame and the third axis being longitudinal to the C-frame. In such known machines, the additional hydraulic means which controls blade rotation about the third axis is not capable of reacting to the force applied to the blade because of its physical orientation and manner of being coupled between the blade and C-frame.

Because of this deficiency, the hydraulic devices of the prior art used to control movement about one of the foregoing perpendicular axes, were required to be of a capacity and size not only sufficient to effect rotational movement of the blade about an axis, but also had to support high forces which the blade generated during the operation of the machine. Thus, hydraulic devices performing this function were required to be relatively large, high capacity cylinders which were economically undesirable, especially when the machine was required to carry out heavy duty operational tasks.

It is, therefore, an object of the invention to improve earth moving machines;

Another object of the invention is to improve the mounting and control of movement of a scraping blade;

A further object of the invention is to control movement of the scraping blade about three perpendicularly extending axes;

Still another object of the invention is to transmit forces applied to the scraping blade in part through a hydraulic device controlling movement of the blade about one of three perpendicularly extending axes.

These and other objects are attained in accordance with the present invention wherein there is provided an earth moving machine having an improved mounting for a scraping blade attached thereto. The scraping blade of the machine herein disclosed is capable of undergoing independent or simultaneous rotational movement about three perpendicular axes and applying high forces to material to be moved. Movement about two of these axes is controlled by two separate pairs of hydraulic cylinders. A hydraulic actuator effects movement of the blade about a third axis and acts to transmit a part of the force applied to the blade during operation to the frame of the machine.

DESCRIPTION OF THE DRAWINGS

Further objects of the invention, together with additional features contributing thereto and advantages accruing therefrom, will be apparent from the following description of several embodiments of the invention when read in conjunction with the accompanying drawings, with like reference numerals indicating corresponding parts throughout, wherein.

DESCRIPTION OF THE PREFERRED EMBODIMENTS

Figure 1:
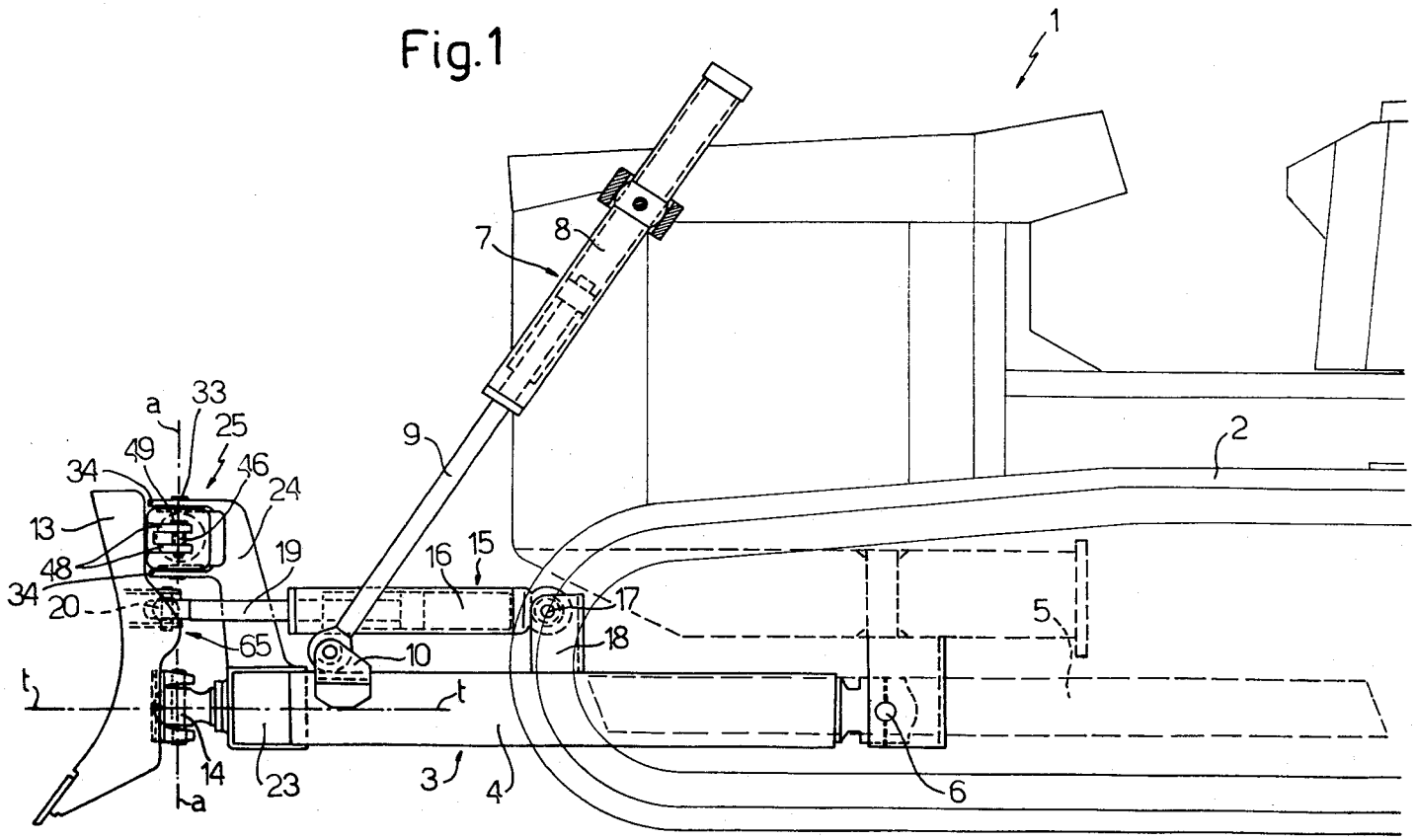
FIG. 1 is a partial side schematic illustration of the front section of an embodiment of an earth moving machine according to the present invention.
Figure 2:
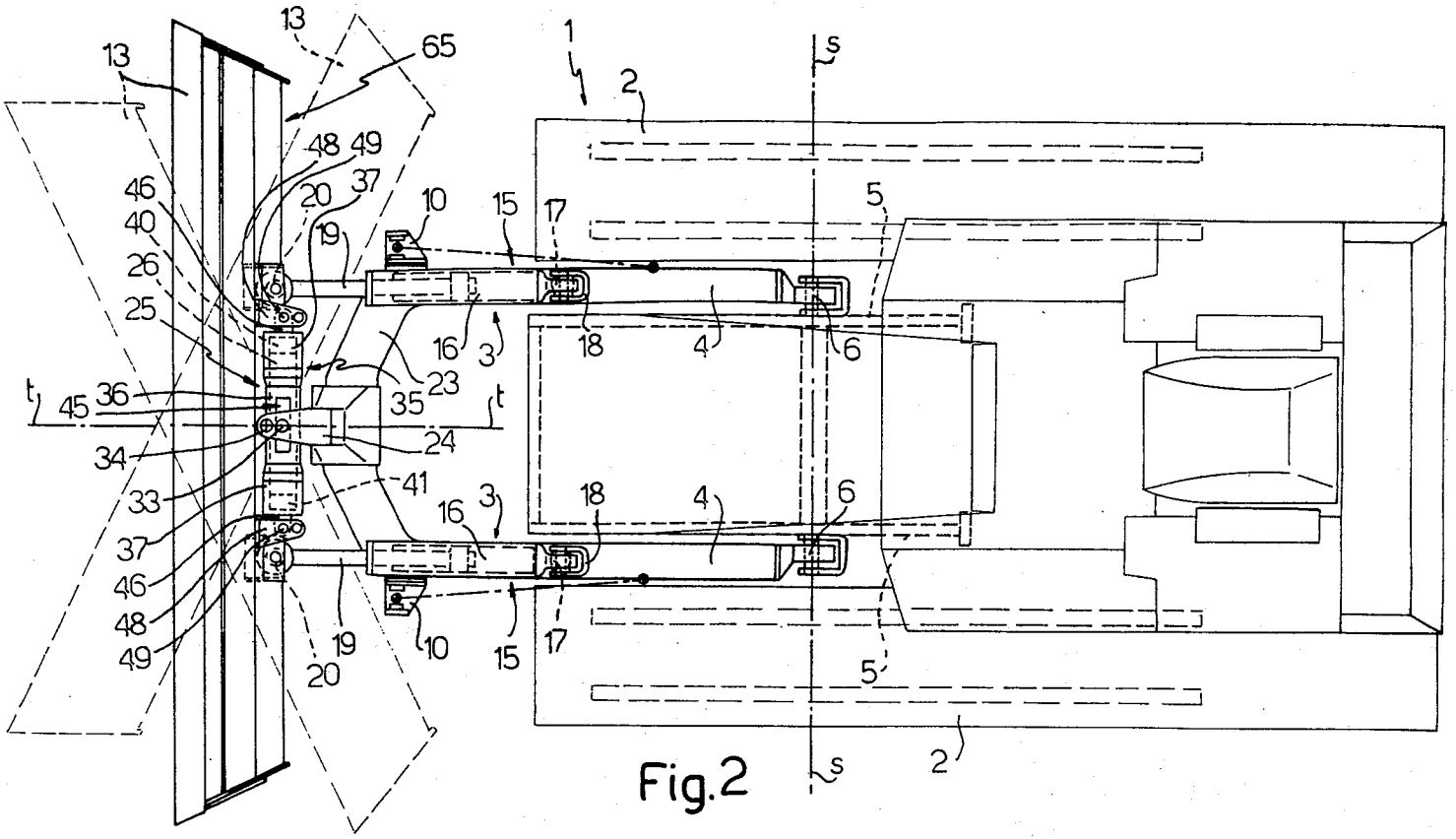
FIG. 2 is a top schematic illustration of the machine of FIG. 1.

With reference to FIGS. 1 and 2, there is illustrated an embodiment of an earth moving machine indicated generally by reference numeral 1, having tracks 2. As best shown in FIG. 2, machine 1 further includes a C-shaped frame 3 provided with a pair of arms 4, each of which is pivotally mounted to the vehicle framework 5 by hinging pins 6, so as to rotate about a first horizontal axis normal to the direction of travel of the vehicle and indicated by line S—S in FIG. 2. Rotation of arms 4 about the axis S—S controls blade elevation during operation.

The blade elevation is controlled by a pair of conventional hydraulic cylinders 7 as shown in FIG. 1, each of which has a housing 8 pivotally attached to the machine framework and an end of a rod 9 hinged to a bracket 10 rigid with the frame 3. Frame 3 supports a scraping blade 13 which is centrally connected thereto by a spherical hinge 14, such as, for example, in the form of a ball joint which allows rotation of the blade relative to the frame about an axis passing through the vertical center of the joint itself.

A second pair of conventional hydraulic cylinders 15 are disposed between the scraping blade 13 and frame 3, and each includes a housing 16 attached by a ball joint 17 to a bracket 18. Bracket 18 is rigidly coupled to one of the arms 4 of frame 3 as shown in FIG. 1. A rod 19, of each of cylinders 15, is hinged to the blade 13 by a ball joint 20 as is apparent from FIGS. 1 and 2. A support member 24 projects upward from the central part of a cross member 23 of frame 3, and supports a hydraulic actuator indicated generally by reference numeral 25 and disposed between support member 24 and blade 13 in a manner to be described in detail.

Figure 3:
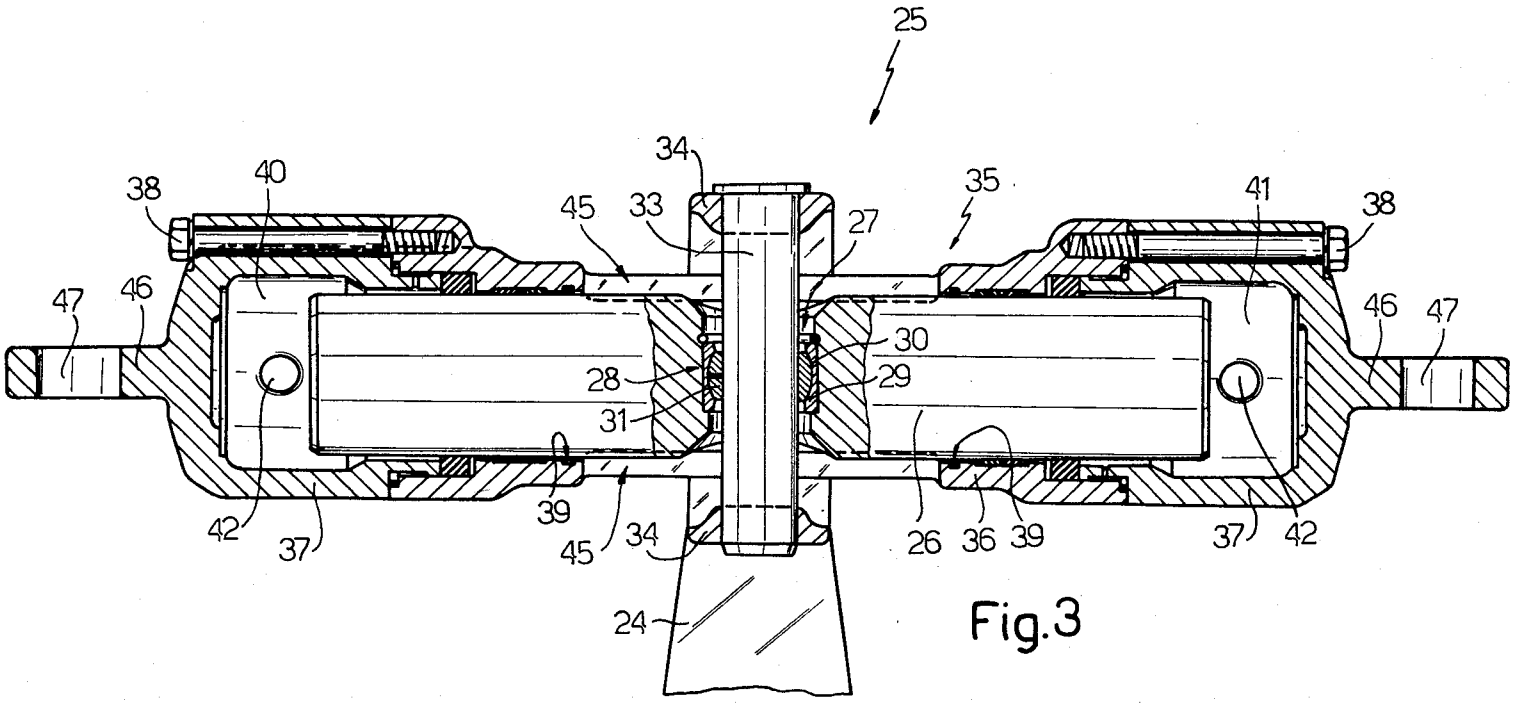
FIG. 3 is a front sectional illustration of a hydraulic actuator utilized to control the rotation of the scraping blade of the machine of FIG. 1 about a rotational axis.

As best shown in FIG. 3, hydraulic actuator 25 includes a substantially cylindrical piston member 26, which is provided with a central bore 27 extending laterally of the longitudinal axis of the piston member. A ball joint, indicated overall by reference numeral 28, is positioned within bore 27 and comprises a first bushing 29 provided with an inner spherical surface 30, and a second bushing 31 provided with an outer spherical surface engaging inner spherical surface 30. Bushing 31 possesses an inner bore through which a pin 33 is disposed. The ends of pin 31 extend through corresponding bores in a pair of spaced arms 34 of a fork formed by a portion of support member 24.

Hydraulic actuator 25 is substantially enclosed by a casing member 35 having a central tubular section 36 and a pair of end closures 37 attached to tubular section 36 by any suitable technique, such as, for example, by screws 38. Central section 36 and end closures 37 define substantially a cylindrical chamber 39, in which piston member 26 is longitudinally moveable. A pair of opposed chambers 40 and 41 are formed by chamber 39 adjacent the opposite ends of piston 26 and into which pressurized hydraulic fluid is directed from a pressure source in the hydraulic control circuit of the machine, which will be described hereinafter. For this purpose, suitable bores 42 are provided in end closures 37 to create fluid communication with the hydraulic control circuit to be described.

As best shown in FIGS. 2 and 3, a pair of diametrically opposing and elongated slots 45 are provided in the central tubular section 36 of casing 35 through which pin 33 extends. The dimension of these slots is chosen in such a manner as to allow the hydraulic actuator 25 to rotate freely about any axis passing through the center of the ball joint 28 without pin 33 coming into contact with the edges of the central section 27 which defines slots 45.

End closures 37 of casing 35 are provided with an integral lug 46 having a bore 47. Lug 46 is positioned in a bracket having a pair of arms 48 which are attached to the rear wall of blade 13 and are also provided with bores. A pin 49 is inserted into the bores of each pair of arms 48 and into the bore 47 of one lug 46 for interconnection with blade 13.

Alternatively, the two arms 34 of the support member 24 and arms 48 attached to blade 13 can be provided with several pairs of aligned bores as shown in FIG. 2, for the purpose described hereinafter. The axes of the bores of each pair are positioned substantially on straight lines normal to the direction of travel of the vehicles.

Figure 4:
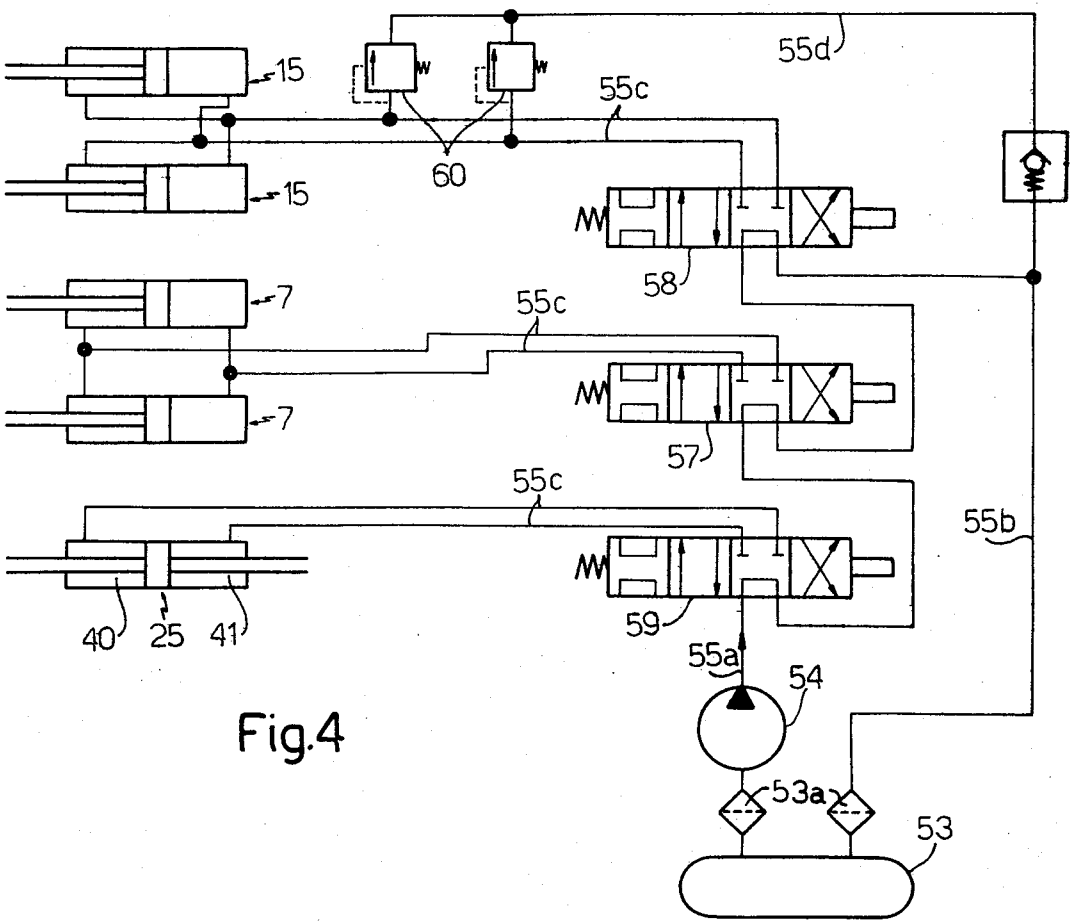
FIG. 4 is a diagrammatical illustration of the hydraulic control circuit of the machine of FIG. 1.

Referring now to FIG. 4, there is illustrated the hydraulic control circuit for the earth moving machine of the invention. The hydraulic control circuit is supplied hydraulic fluid from a reservoir tank 53 through filters 53*a*. A pump 54 is coupled to tank 53 and filter 53*a* and directs hydraulic fluid under pressure through a feed conduit 55*a* into hydraulic cylinders 7 and 15 and to hydraulic actuator 25 for introduction through bores 42. The hydraulic fluid which is discharged from hydraulic cylinders 7 and 15 is returned to tank 53 through return conduits 55*b*.

Hydraulic cylinders 7 and 15 and hydraulic actuator 25 are controlled by manually operated valves 57, 58, and 59, respectively, connected in series with each other and to return tube conduit 55*b*. Each of the valves controls the introduction of pressurized hydraulic fluid into the two opposed chambers of hydraulic cylinders 7, 15, and hydraulic actuator 25, and controls discharge therefrom in a conventional manner. For this purpose, each of the chambers of cylinders 7 and 15 and actuator 25 is in fluid communication with its respective control valve through a pair of conduits 55*c*. Advantageously, for the purpose indicated hereinafter, conduits 55*c* coupled to cylinders 15 are connected directly to the discharge conduit 55*b*, by means of bypass conduit 55*d*. An overpressure valve 60 is provided between each conduit 55*c* which is coupled to each of the hydraulic cylinders 15 and bypass conduit 55*d*.

Figure 5:
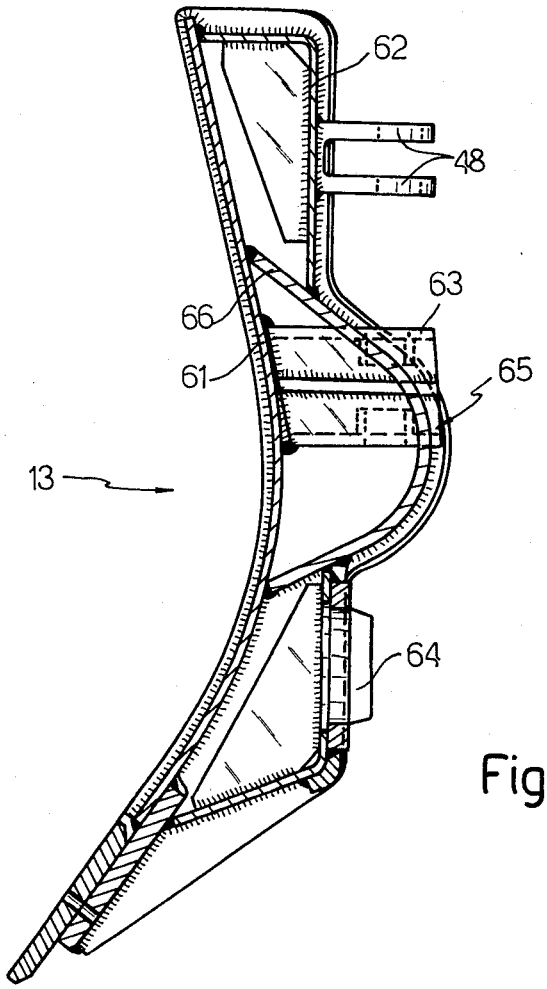
FIG. 5 is an end vertical sectional illustration through the scraping blade of the machine of FIG. 1.

Referring to FIG. 5, there is shown for purpose of illustration, one form of the scraping blade 13 which may be utilized in conjunction with the machine of the invention. Blade 13 is formed with a front wall 61 of suitable shape for being brought into contact with a mass of earth and the like, and a rear wall 62 affixed to the front wall by any suitable technique such as, for example, by welding. Arms 48 which are in coupling relationship to actuator 25 are attached to rear wall 62. Connectors 63 for piston rods 19, and connectors 64 for ball joint 14 are also coupled to rear wall 62. Blade 13 may include a stiffening rib 65, with the cross-section shown in FIG. 5, and constructed by disposing a wall member 66 substantially of U-shape between the walls 61 and 62. Rib 65 has proven particularly useful to resist the high forces to which blade 13 is subjected during operation of the machine, and to prevent deformation and damage to the blade.

Figure 6:
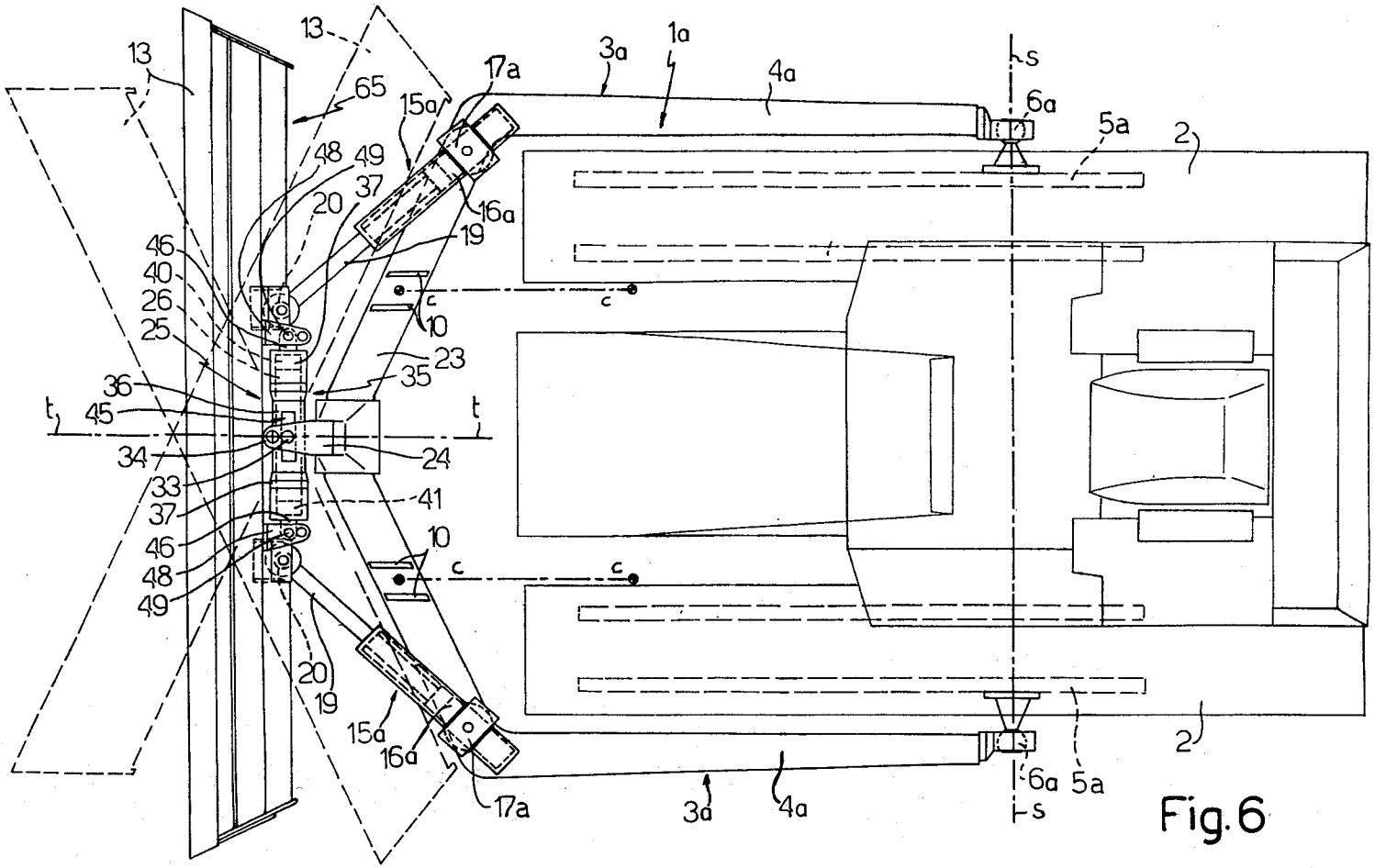
FIG. 6 is a schematic illustration of another description of preferred embodiments of an earth moving machine according to the present invention.

Referring now to FIG. 6, there is illustrated another embodiment of the earth moving machine 1*a* according to the invention. The embodiment of FIG. 6 differs from that of FIG. 1 in that the C-frame 3 is pivotally connected by hinging assembly 6*a* to longitudinal members 5*a* of a track frame, each of which is disposed within a corresponding track assembly 2. In addition, the axes of the hydraulic cylinders 15*a* (shown in their rest position) are not parallel to each other or to the axis passing through the longitudinal centerline of the machine. Instead the longitudinal axes of cylinders 15*a* are disposed at a predetermined angle along axis t—t of less than 90°. A portion of housing 16*a* of each cylinder 15*a* is attached to the C-frame 3 by a ball joint 17*a*. The other parts of the machine are identical to those described with reference to the preceding embodiment shown in FIGS. 1 and 2.

It should be noted that the longitudinal axes of the cylinders 7 (not shown in FIG. 6) which are indicated by reference c—c remain substantially unchanged, and correspond to that of FIGS. 1 and 2. C-frame 3 possesses a slightly different configuration in the embodiment in FIG. 3 as a consequence of its altered attachment to the longitudinal members 5*a* of the track frame. In certain applications, the embodiment of FIG. 6 is preferable to the embodiment shown in FIGS. 1 and 2 dependent on encountered operation.

The operation of the machine shown in FIGS. 1 and 2 is identical to the operation of the machine of FIG. 6. In operation, valve 57 (shown in FIG. 4) is actuated manually to cause hydraulic fluid to be directed under pressure into the lower chambers of hydraulic cylinders 7 of FIG. 1, which raises frame 3 by rotating it about the axis s—s and consequently elevates scraping blade 13. At the same time, hydraulic fluid is discharged into the discharge conduit 55*b*, best shown in FIG. 4, from the upper chambers of cylinders 7. Scraping blade 13 can be lowered by operating the valve 57 to direct hydraulic fluid under pressure to the upper chambers of both cylinders 7 and causing discharge from the lower chambers through discharge conduit 55*b*.

To rotate the scraping blade 13 about a vertical axis passing through the center of the ball joint 14 (shown as axis a—a in FIG. 1) and alter the blade angle, valve 58 is operated to direct pressurized hydraulic fluid into the rear chamber of one of the two cylinders 15 and into the front chamber of the opposite cylinder 15. As is apparent, hydraulic fluid is thereby discharged from the opposite two chambers of cylinders 15 from which pressurized hydraulic fluid is received. Under the action of the oppositely directed forces, which the rods 19 of cylinders 15 apply, the angle of blade 13 is altered about the axis a—a indicated in FIG. 1 which passes through the center of ball joint 14 and through the axis of the pin 33. It should be apparent that actuator 25 allows rotation about axis a—a because of the presence of the ball joint 28 of actuator 25 which possesses a center lying on the axis of the pin 33.

When it is required to rotate blade 13 in a predetermined direction about the axis t—t of FIG. 2, which passes through the center of the joint 14 parallel to the direction of travel of the machine in control of tilt of the blade, valve 59 as shown in FIG. 4 is operated to direct hydraulic fluid under pressure into one of the two chambers 40 or 41 of actuator 25 and to discharge oil from the opposing chamber. Under these conditions the pressurized hydraulic fluid entering one of the chambers 40 or 41 causes casing 35 (as shown in FIG. 3) to move axially relative to the piston member 26, thus causing scraping blade 13 to rotate about the axis t—t. Simultaneously, actuator 25 is caused to rotate about an axis passing through the center of the ball joint 28, normal to the plane of the drawing in FIG. 3.

Such rotations about the axes s—s, a—a, and t—t can obviously be carried out simultaneously by suitably operating the control valves for each of the hydraulic devices in order to make blade 13 execute a complex movement resulting from the combination of the three elementary rotations.

The purpose of the valves 60 in the hydraulic circuit of FIG. 4 is to enable part of the oil to be discharged from one of the chambers of cylinders 15 when there is a small displacement of their pistons resulting from a rotation of blade 13 about the axis t—t. In this regard, it should be apparent that the distance between the ball joints 17 and 20 of each cylinder 15 must vary during such rotation.

Regardless of the angular position of the scraping blade 13, the resultant of the forces applied to the scraping blade during operation is transmitted to the frame 3 not only by way of the ball joint 14 and hydraulic cylinders 15, but through the hydraulic actuator 25, which is able to effectively react to the resultant force. Thus, a force applied to the scraping blade 13 is transmitted to the casing 35 of the hydraulic actuator 25, piston member 26, and subsequently to support member 24 attached to frame 3 through joint 28 and pin 33.

In accordance with the earth moving machine of the invention, high working forces can be exerted by the scraping blade 13 by virture of the existence of a pair of connections constituted by ball joint 14 and actuator 25, which are able to directly transmit the working forces from the blade to the frame. Consequently, the function of the cylinders 15 is only to vary the angular position of the scraping blade 13 about the vertical axis a—a, but not to support a substantial part of the working forces. Thus, these cylinders can be of small dimensions and have limited and economical overall size and capacity.

In the machine according to the invention, it is possible to vary the angle of incidence or pitch of the scraping blade 13 to the working plane, by inserting pin 33 as shown in FIG. 2 into a different pair of bores in arms 34 of the support member 24. For purposes of illustration, only two pairs of bores in arms 34 are shown, but other numbers of pairs of bores may be employed to further permit adjustment of the angle of incidence of the blade. The pitch of the blade 13 can also be adjusted by varying the connection between the lugs 46 shown in FIG. 3 and arms 48 of FIG. 1 of the blade 13. These latter arms are also provided with several pairs of bores. The selection of a suitable pair for the connection between lugs 46 and arms 48 allows the altering of the pitch angle between the blade and working surface.

While the invention has been described with reference to a preferred embodiment, it will be understood by those skilled in the art that various changes may be made and equivalents may be substituted without departing from the scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An earth moving machine comprising frame means supporting a scraping blade, said scraping blade being coupled to said frame means by mounting means for movement about a first axis normal to the longitudinal axis of the machine, second support means coupling the scraping blade to the frame means for movement about a second axis extending vertically and normal to the first axis, hydraulic means coupled to the frame means and the scraping blade to effect selective rotation of the scraping blade about said first and second axis, hydraulic actuator means further coupling the scraper blade to the frame means to transmit at least part of the forces applied to the scraping blade during operation to the frame means and to permit rotation of the scraping blade about a third axis normal to said first and second axis, said hydraulic actuator including a chamber member and a piston member movable in an axial horizontal direction therein in response to the application of fluid pressure applied thereto, said scraping blade being rigidly coupled to said chamber member, said frame means including support means projecting vertically upward from said frame means and disposed substantially in the vertical center plane of the frame means, and said piston is further coupled to said support means by hinge means.

2. A machine as claimed in claim 1 wherein said hinge means includes at least one spherical surface coupling said piston to said support means to permit said movement of said scraping blade about said third axis.

3. A machine as claimed in claim 2 further including connection means rigidly coupling said chamber to said scraping blade.

4. A machine according to claim 3, wherein said connection means includes at least one lug coupled to the chamber member and having at least one bore, said connection means further including at least one member rigidly attached to said scraping blade and having at least one bore alignable with the bore of the lug, and pin means adapted to be inserted into the alignable bores.

5. A machine as claimed in claim 2, wherein said support means includes means to vary the pitch of the scraping blade relative to a working plane.

6. A machine according to claim 5, wherein said connection means includes means to vary the pitch of the scraping blade relative to the working plane.

7. The machine according to claim 1, wherein said scraping blade includes a stiffening rib extending substantially along a horizontal axis.

8. A machine according to claim 7 wherein said scraping blade includes a front wall adapted to contact the material to be moved, and a rear wall to which said connection means is coupled.

9. A machine as claimed in claim 8, wherein said stiffening rib is a substantially U-shaped element extending between said front and rear walls.

* * * * *